US005296345A

United States Patent [19]

Yamashita et al.

[11] Patent Number: 5,296,345

[45] Date of Patent: Mar. 22, 1994

[54] SILVER HALIDE PHOTOGRAPHIC MATERIAL

[75] Inventors: Seiji Yamashita; Masaki Okazaki; Tadashi Ikeda, all of Kanagawa, Japan

[73] Assignee: Fuji Photo Film Co., Ltd., Kanagawa, Japan

[21] Appl. No.: 933,184

[22] Filed: Aug. 21, 1992

[30] Foreign Application Priority Data

Aug. 27, 1991 [JP] Japan ..... 3-238884

[51] Int. Cl.[5] ..... G03C 1/08; G03C 1/29

[52] U.S. Cl. ..... 430/574; 430/567; 430/569; 430/603

[58] Field of Search ..... 430/574, 603, 567, 569

[56] References Cited

U.S. PATENT DOCUMENTS 3,772,031 11/1973 Berry et al. ..... 430/603
3,814,609 6/1974 Shiba et al. .
3,864,134 4/1975 Ueda et al. ..... 430/574
4,594,317 6/1986 Sasaki et al. ..... 430/574

FOREIGN PATENT DOCUMENTS 2-47647 2/1992 Japan .

*Primary Examiner*—Thorl Chea
*Attorney, Agent, or Firm*—Sughrue, Mion, Zinn, Macpeak & Seas

[57] ABSTRACT

A silver halide photographic material is descloosed, comprising a support having thereon at least one silver halide emulsion layer, wherein the silver halide emulsion layer contains at least $1\times10^{-4}$ mol of a compound represented by formula (I) per mol of silver halide and from $1\times10^{-3}$ to $1\times10^{-1}$ mol of compound represented by formula (II) per mol of the compound of formula (I) and the iodine content of the silver halide emulsion is 1 mol % or less:

(I)

(II)

wherein $R_1$, $R_2$, $R_3$, $R_4$, $R_5$, $R_6$, $R_7$, $Z_1$, $Z_2$, $Z_3$, $Z_4$, $X^{\ominus}$ and n are defined in the specification. The photographic material is highly sensitive, can be processed rapidly, and does not fatigue the developer, yet it contains only a small percentage of iodine, if any. The photographic material is useful in photographic films including X-ray films.

9 Claims, No Drawings

SILVER HALIDE PHOTOGRAPHIC MATERIAL

FIELD OF THE INVENTION

The present invention relates to a silver halide photographic material, and more particularly to a silver halide photographic material suitable for rapid photographic processing.

BACKGROUND OF THE INVENTION

The increasing use in recent years of silver halide photographic materials has resulted in a need for rapid processing of such materials. This trend is seen, for example, in the field of medical X-ray photographic films. As the number of X-ray diagnoses associated with health examinations increases, the number of X-ray photographs increases also. At the same time, the necessity of obtaining the results of the diagnoses as soon as possible has placed a premium on rapid photographic processing.

To process large amounts of photographic materials and do it rapidly, it is necessary to decrease the replenishing amount of each processing solution and to shorten the processing time for the development, fixing, washing and drying steps.

Decreasing the replenishing amounts and the time for each processing step leads to problems recognized in the art. These include: (1) developer fatigue; (2) residual color formation due to the hindrance of the desorption of dyes; and (3) inadequate fixing. These problems cannot be ignored.

The use of iodine or an iodine ion is one recognized means of addressing some of the problems inherent in rapid processing. However, the use of iodine has its own set of problems. When an iodine ion is used to lower developer fatigue and the development restraining action, the amount of developer replenisher must be increased. Also, as described for example in JP-A-2-68540 (The term "JP-A" as used herein means an unexamined published Japanese patent application), while iodine improves the adsorption of dyes, it increases residual color formation associated with spectral sensitizing dyes. To prevent this increase in residual color formation, the processing times for fixing and washing must be increased. This is same as to inadequate fixing.

Despite the problems associated with the use of iodine, the general outlook in the art has been that iodine is an essential component in silver halide emulsions, and, in particular, in silver halide emulsions that are highly sensitive, have excellent development properties, and are rapidly processable. This is described, for example, in JP-B-63-38692 (The term "JP-B" as used herein means an examined Japanese patent publication) and JP-A-63-305343.

SUMMARY OF THE INVENTION

The present inventors have invented a silver halide photographic material that is more highly sensitive, has better developability, and can be processed more rapidly than comparable photographic materials that contain a significant percentage of iodine. And yet, the photographic material of the present invention contains only a very small percentage of iodine or no iodine at all.

The use of a small amount of a dye which has the more anodic oxidation potential to improve the spectral sensitization ratio is a known supersensitizing technique. This technique is described, for example, in T. H. James, *The Theory of the Photographic Process*, Vol. 10, and in JP-A-2-47647 and JP-A-1-158436. This technique is particularly useful in cases where the dye being used has a lower reduction potential than the conductive band end of the silver halide.

Those skilled in the art are of the general view that various dyes within the scope of formula (I) of the present specification, as set forth below, exhibit a sufficiently high degree of spectral sensitization when used alone, without a supersensitizer. It is known in the art, however, that when the iodide content of the silver halide grains in the emulsion is 1 mol % or less, the absorption state of the dye changes (the absorption decreases), and the spectral sensitization ratio decreases also. In addition, the intrinsic sensitivity of the silver halide emulsion drops drastically. This latter phenomenon is a recognized problem called "dye desensitization."

The present inventors have discovered how to prevent the decrease in the spectral sensitization ratio and solve the dye desensitization problem at the same time. Specifically, where the iodide content of the silver halide emulsion is 1 mol % or less, the present inventors have found that the use in combination of a small amount of a dye having a more anodic oxidation potential, preferably by at least 0.2 eV, than that of a dye within the scope of formula (I) set forth below stops the decrease in the spectral sensitization ratio and eliminates the dye desensitization problem. That is, the difference of the oxidation potential between the preferred dye used and the dye within the scope of formula (I) is at least 0.2 eV.

The inventors have found that these phenomena are specific to cases where a silver halide emulsion having a low iodide content (i.e., not more than 1 mol %) is used in combination with a dye within the scope of formula (I). The present invention and its advantages are not described or suggested in any prior literature of which the inventors are aware.

It is known in the art that tabular silver halide grains are suitable for spectral sensitization and have a high covering power (optical density per unit of developed silver) owing to their broad surface area. In particular, they are widely used in medical X-ray photographic films, etc., and there are many publications describing their utility. See, for example, JP-A-58-127921.

The present inventors have discovered that the present invention gives particularly remarkable effects when tabular silver halide grains are used. While the inventors do not wish to be limited by any theory of how their invention works, they believe the reason for this is as follows. Tabular silver halide grains have a large surface area per unit volume and therefore the amount of iodine per unit surface area is less than it is in grains that have a lower surface-to-volume ratio. Since the probability that an iodine ion exists to the adsorbed dye in this case is lowered, a decrease in the spectral sensitization ratio and dye desensitization are very likely to occur.

It is known that sulfur sensitization, chemical sensitization using selenium (Se) or tellurium (Te), and combinations of these sensitization methods give high sensitization. See, for example, JP-A-60-151637 and JP-A-61-67845.

It is also known that the use in combination of one or more of the foregoing sensitization methods (i.e., sulfur, selenium, and/or tellurium sensitization) with a spectral sensitizing method gives an excellent sensitizing effect, as described in JP-A-59-185530. Similarly, it is known that the use in combination of a reduction sensitization method and a spectral sensitization method can give excellent sensitizing effects, as described, for example, in JP-B-57-33572, JP-A-2-191938 and JP-A-2-136852.

Many publications describe in varying levels of detail the use of the sensitization methods described in the preceding two paragraphs in combination with supersensitization methods. However, very few if any publications describe the basic phenomenon observed by the present inventors and described above. That is, when dyes within the scope of formula (I) as set forth below are used in an iodine-containing silver halide emulsion, the spectral sensitization ratio decreases and dye desensitization occurs when the iodine content of the emulsion is reduced 1 mol % or less.

As described above, the present inventors have discovered how to stop the decrease in the spectral sensitization ratio and solve the dye desensitization problem. They have discovered, in addition, that selenium (Se), tellurium (Te), and reduction sensitization methods are particularly effective when used in combination with the supersensitization method of the present invention. So far as the inventors are aware, this is not described anywhere in the prior literature.

While the inventors do not wish to be limited by any theory of how their invention works, they believe that the improvements obtained using selenium, tellurium and reduction sensitization in the context of the present invention may be explained as follows.

Typically, when supersensitization is carried out using a dye which has the more anodic oxidation potential, the spectral sensitization ratio is improved and decrease of inherent sensitivity is reduced. In systems where the inefficiency in the sensitizing step is reduced as described above, the use of a supplemental sensitization technique such as selenium, tellurium or reduction sensitization may narrow the sensitized band width. In fact, as shown in Example 1 of the present specification, when 1 mol % or more iodine is used in the silver halide emulsion, the sensitized band width obtained using selenium, tellurium or reduction sensitization is narrow.

The inventors believe that this occurs because in supersensitization, the positive holes of dyes are localized in dyes which have the more anodic oxidation potential and are therefore liable to become recombination centers. Thus, the inefficiency is carried in. These localized positive holes of dyes can be detected by the electron spin resonance method described in *Photographic Science and Engineering* Vol. 19, (No. 6) pages 356 to 363 (1975).

In silver halide emulsions having a higher silver iodine content, the valence band of the silver halide is in a more anodic tendency and the positive holes of dyes are destabilized, whereby the foregoing inefficiency is unlikely to occur. On the other hand, it is considered that a silver halide emulsion having a lower silver iodide content (i.e., 1 mol % or less) is liable to cause the foregoing inefficiency but on the other hand, since the silver halide emulsion is liable to be influenced by selenium, tellurium or reduction sensitization, which is effective for the prevention of the inefficiency, the silver halide emulsion is liable be sensitized.

It is very important to reduce the thickness of photographic light-sensitive materials to enable them to be processed rapidly. Also, it is well known that development speed, fixing and washing efficiency, and drying speed can be improved by reducing the silver content in the silver halide emulsions and by reducing the amount of binder for the photographic material, as disclosed in JP-A-1-158434, JP-A-1-158436, JP-A-2-68537, etc.

However, reducing the amount of binder for the photographic material greatly increases the occurrence of pressure blackening before and during processing of the photographic material. Also, to reduce the coating amount of silver in the photographic material, it is necessary to use a silver halide emulsion containing fine silver halide grains and having a high sensitivity. It is known in the art that silver halide emulsions having a high sensitivity to light are also highly sensitive to pressure. Accordingly, it is difficult from a technical standpoint to reduce the silver content and reduce the thickness of the photographic layer(s) of the photographic material.

The present inventors have surprisingly found that the silver halide emulsion for use in the present invention has an astonishingly high pressure blackening resistance in spite of its high sensitivity. The inventors have also found that the emulsion for use in the invention provides a photographic material that can be processed rapidly and that provides excellent photographic performance even when the amount of binder and the coating amount of silver are reduced (i.e., the silver/-binder weight ratio is at least 0.8).

Rapid processing in the content of the present invention means a total processing time of from 15 to less than 55 seconds. The total processing time is the total time of from the introduction of the head end of a photographic film into an automatic processor to the emergence thereof from the drying section, the photographic material having passed through a development bath, a transporting space, a fixing bath, a second transporting space, a washing bath, a third transporting space, and the drying section. In other words, the total processing time is equal to the total length of the processing line divided by the line transporting speed. The reason for including the transporting spaces in the calculation is that a processing step is actually proceeding in each transporting space since the gelatin layers of the photographic film are swelled with the processing liquid from the previous processing step, as is well known in the art.

An object of the present invention is to overcome the foregoing problems in conventional techniques where the photographic material is rapidly processed such that the total processing time is from 15 to less than 55 seconds.

Another object of the present invention is to provide the silver halide photographic material having a high sensitivity.

A further object of the present invention is to provide the silver halide photographic material having excellent fixing and drying properties.

A further object of the present invention is to provide the silver halide photographic material having no residual color formation.

A still further object of the present invention is to provide the photographic material having no fatigue of the developer with accumulated iodine ions.

These objects have been attained with a silver halide photographic material comprising a support having thereon at least one silver halide emulsion layer, wherein the silver halide emulsion contains a compound represented by formula (I) in an amount of at least $1\times10^{-4}$ mol per mol of silver halide in the silver halide emulsion and a compound represented by formula (II)

in an amount of from $1\times10^{-3}$ to $1\times10^{-1}$ mol per mol of the amount of the compound of formula (I), and the iodine (i.e., the iodide) content of the silver halide emulsion is not more than 1 mol %;

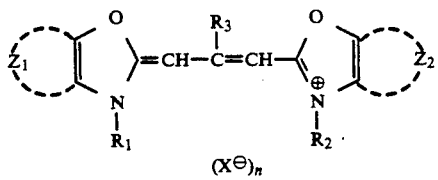

(I)

wherein $R_1$ and $R_2$ each represents a substituted or unsubstituted alkyl group, a substituted or unsubstituted alkenyl group, or a substituted or unsubstituted aryl group, and at least one of $R_1$ and $R_2$ is a sulfoalkyl group or a carboxyalkyl group; $R_3$ represents a substituted or unsubstituted alkyl group; $X^{\ominus}$ represents a counter ion necessary to balance the charge of the molecule; n represents a number necessary to balance the charge; and $Z_1$ and $Z_2$ each represents a group of nonmetallic atoms necessary to form a substituted or unsubstituted benzene ring or a substituted or unsubstituted naphtho ring; and when the molecule of formula (I) forms an intermolecular salt, n is 0;

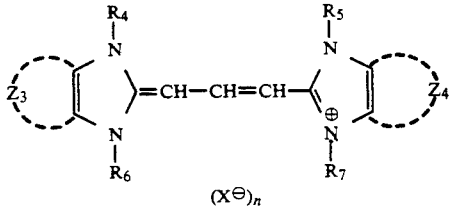

(II)

wherein $R_4$ to $R_7$ each represents a substituted or unsubstituted alkyl group; $X^{\ominus}$ represents a counter ion necessary to balance the charge of the molecule; n represents a number necessary to balance the charge; $Z_3$ and $Z_4$ each represents a group of nonmetallic atoms necessary to form a substituted or unsubstituted benzene ring or a substituted or unsubstituted naphtho ring; and when the molecule of formula (II) forms an intermolecular salt, n is 0.

DETAILED DESCRIPTION OF THE INVENTION

The compounds represented by formula (I) are described in detail below.

In formula (I), $R_1$ and $R_2$ may be the same or different. $R_1$ and $R_2$ each represents an alkyl group having from 1 to 4 carbon atoms (e.g., methyl, ethyl, propyl, butyl) which may be substituted with a substituent (e.g., a halogen atom or a hydroxyl group), a substituted or unsubstituted alkenyl group having 4 or less carbon atoms (e.g., allyl, 2-butenyl), or a substituted or unsubstituted aryl group. At least one of $R_1$ and $R_2$ is a sulfoalkyl group having from 2 to 4 carbon atoms (e.g., 2-sulfoethyl, 3-sulfopropyl, 3-sulfopropyl, 3-sulfobutyl, 4-sulfobutyl, 2-[3-sulfopropoxy]ethyl, 2-hydroxy-3-sulfopropyl, 3-sulfopropylethoxyethyl), or a carboxyalkyl group (e.g., 2-carboxyethyl, 3-carboxypropyl, 4-carboxybutyl, carboxymethyl).

$R_3$ represents a substituted or unsubstituted alkyl group having 1 or 2 carbon atoms (e.g., methyl, ethyl).

$X^{\ominus}$ represents an anion such as a halogen ion ($I^-$, $Br^-$, $Cl^-$, etc.).

$Z_1$ and $Z_2$ each represents a group of nonmetallic atoms necessary to form a benzene ring or a naphtho ring, either of which may form a condensed ring or may have a substituent such as a halogen atom, a cyano group, an alkyl group, an alkoxy group, an aryl group, a trifluoromethyl group, an alkoxycarbonyl group, an acyl group, etc.

Also, n represents 1 or 2, but when the dye represented by formula (I) forms an intramolecular salt, n is 0.

In addition, when $R_1$, $R_2$, or both are a sulfoalkyl group or a carboxyalkyl group, the the sulfoalkyl group or the carboxyalkyl group or both may form a salt of the structure R—$SO_3M$ or R—COOM, wherein M represents a hydrogen atom, an alkali metal atom (e.g., Na, K), or an ammonium group.

The dye compounds represented by formula (II) are described in detail below.

In formula (II), $R_4$, $R_5$, $R_6$, and $R_7$ each represents an unsubstituted alkyl group having from 1 to 4 carbon atoms (e.g., methyl, ethyl, propyl, butyl) or a substituted alkyl group such as a hydroxyalkyl group, a carboxyalkyl group, an alkoxyalkyl group (e.g., 2-methoxyethyl, 2-ethoxyethyl), a halogenated alkyl group (e.g., 2-chloroethyl, 2,2,2-trifluoroethyl, 2,2,3,3-tetrafluoropropyl), an alkoxycarbonylalkyl group (e.g., methoxycarbonylmethyl, 2-methoxycarbonylethyl), an acyloxyalkyl group (e.g., 2-acetyloxyethyl, 3-acetyloxyethyl), a sulfoalkyl group, etc. The foregoing carboxyalkyl group may form a salt of the structure R—$SO_3M$ or R—COOM, wherein M represents a hydrogen atom, an alkali metal atom such as Na, K, etc., or an ammonium group.

$Z_3$ and $Z_4$ each represents a group of nonmetallic atoms necessary to form a benzene ring or a naphtho ring, either of which may form a condensed ring and may be substituted with a halogen atom (e.g., Cl, Br, F); a trifluoromethyl group; a —COOR group, wherein R represents a hydrogen atom, an alkyl group having from 1 to 5 carbon atoms (e.g., methyl, ethyl, propyl, butyl, pentyl), an aryl group (e.g., phenyl), etc.; or a cyano group.

Also, $X^{\ominus}$ and n have the same meaning as defined in formula (I).

The amount of the dye represented by formula (I) used in the photographic material is at least $1\times10^{-4}$ mol, and preferably from $1\times10^{-4}$ to $1\times10^{-2}$ mol, per mol of silver halide in the silver halide emulsion.

The amount of the dye represented by formula (II) used in the photographic material is from $1\times10^{-3}$ to $1\times10^{-1}$ mol, and preferably from $1\times10^{-3}$ to $1\times10^{-2}$ mol, per mol of the amount of the dye represented by formula (I) that is incorporated in the photographic material. If the amount of the dye represented by formula (II) is too large, dye desensitization occurs, and also, where the dyes are used for, e.g., medical X-ray photographic materials, the formation of safelight fog is likely to increase.

The dyes represented by formulas (I) and (II) may be added to the silver halide emulsion in any suitable step, for example, during the formation of the silver halide grains, during chemical sensitization of the emulsion, or during coating of the emulsion. Further, the dyes represented by formulas (I) and (II) may be added simultaneously or separately.

Also, the dyes of formulas (I) and (II) may be added as a solution thereof in a solvent such as methanol, etc., or as a dispersion of fine crystals in an aqueous gelatin solution.

Specific examples of the dyes represented by formulas (I) and (II) are given below, but it should be understood that the invention is not limited to these compounds.

Specific Examples Of Dyes Represented By Formula (I)

I-1

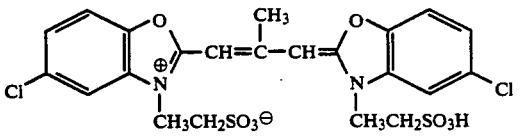

I-2

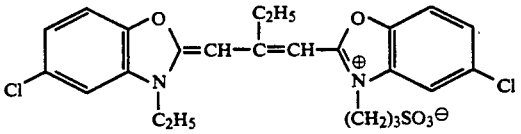

I-3

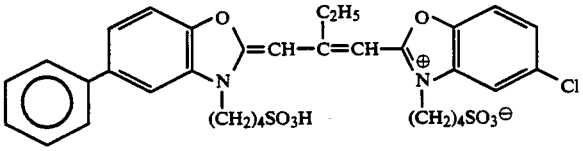

I-4

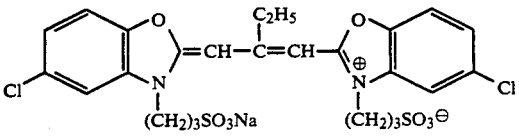

I-5

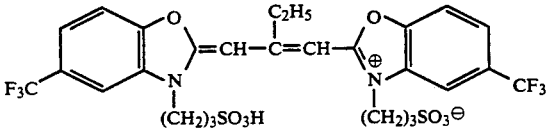

I-6

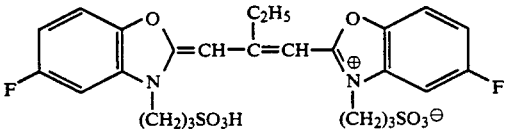

I-7

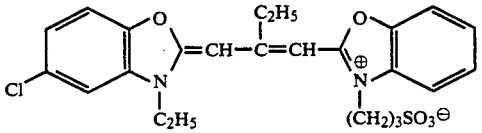

I-8

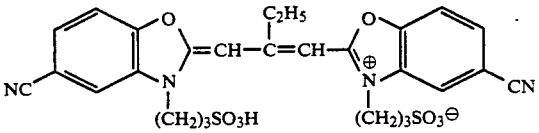

I-9

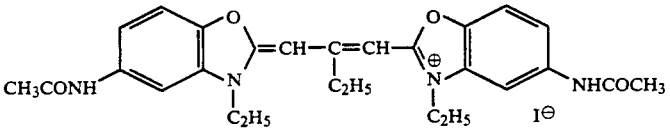

I-10

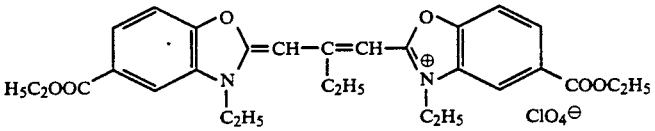

I-11

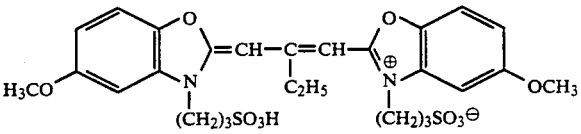

I-12

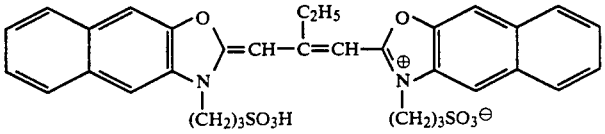

Specific Examples Of Dyes Represented By Formula (II)
II-1
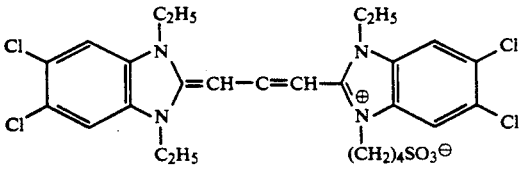
II-2
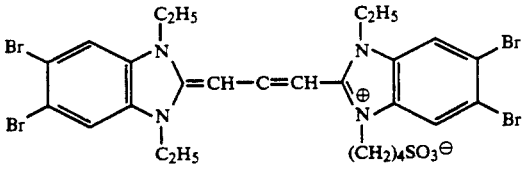
II-3
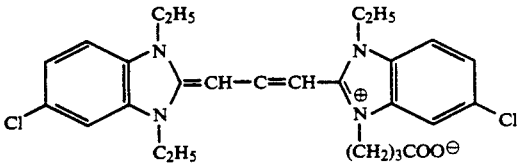
II-4
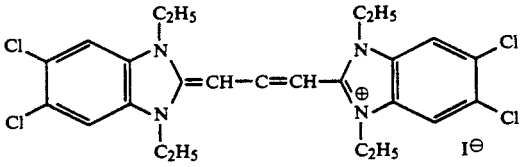
II-5
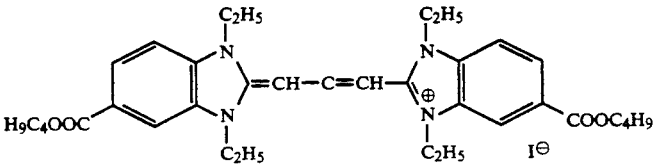
II-6
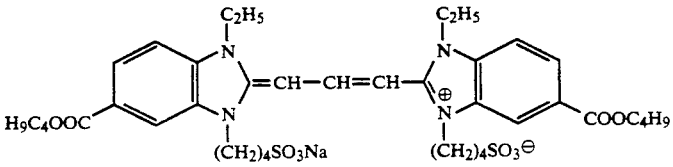
II-7
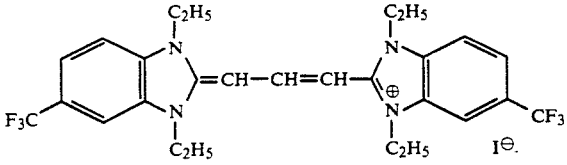
II-8
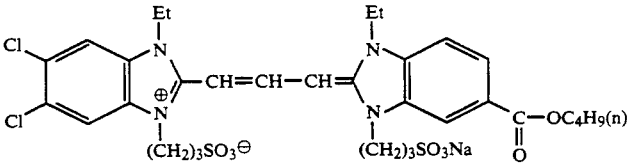
II-9
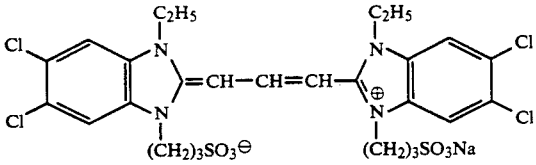
II-10
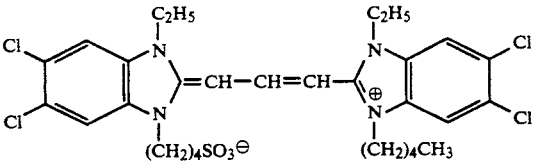
II-11
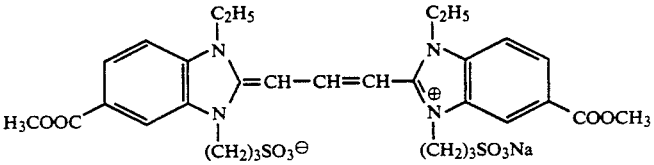
II-12
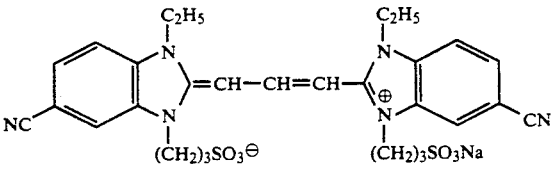
II-13
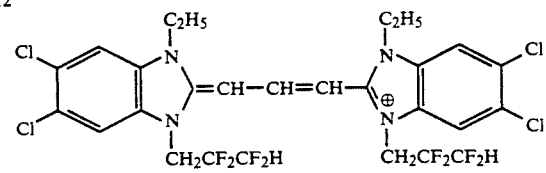

-continued

Specific Examples Of Dyes Represented By Formula (II)

II-14

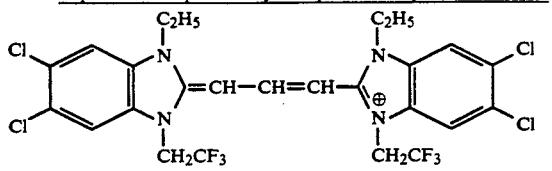

$I^{\ominus}$

The silver halide emulsion for use in the present invention is preferably selenium-sensitized. The selenium sensitization may be carried out using a conventional method. For example, the selenium sensitization may be carried out by adding an unstable type selenium compound and/or a stable type selenium compound to the silver halide emulsion and stirring the emulsion at a high temperature (preferably not less than 40° C.), for a definite time. A preferred method of selenium sensitization uses the unstable selenium sensitizers described in JP-B-44-15748.

Specific examples of unstable selenium sensitizers include aliphatic isoselenocyanates such as allyl isoselenocyanate, etc., selenoureas, selenoketones, selenoamides, selenocarboxylic acids, selenocarboxylic acid esters, and selenophosphates. Particularly preferred unstable selenium compounds are set forth below:

I. Colloidal metal selenium

II. Organic selenium compounds in which a selenium atom is double-bonded to a carbon atom in the organic compound by a covalent bond, including:

a. Isoselenocyanates

For example, aliphatic isoselenocyanates such as allyl isoselenocyanate, etc.

b. Selenoureas (including enol types)

For example, aliphatic selenoureas having an aliphatic group such as methyl, ethyl, propyl, isopropyl, butyl, hexyl, octyl, dioctyl, tetramethyl, N-(β-carboxyethyl)-N,N'-dimethyl, N,N-dimethyl, diethyl, dimethyl, etc.; aromatic selenoureas having one or more aromatic groups such as phenyl, tolyl, etc.; and heterocyclic selenoureas having a heterocyclic group such as pyridyl, benzothiazolyl, etc.

c. Selenoketones

For example, selenoacetone, selenoacetophenone, selenoketones wherein an alkyl group is bonded to a C=Se group, and selenobenzophenone.

d. Selenoamides

For example, selenoacetamide, etc.

e. Selenocarboxylic acids and esters thereof

For example, 2-selenopropionic acid, 3-selenobutyric acid, and methyl-3-selenobutyrate.

III. Other organic selenium compounds, including:

a. Selenides

For example, diethyl selenide, diethyl diselenide, and triphenylphosphine selenide.

b. Selenophosphates

For example, tri-p-tolyl selenophosphate and tri-n-butyl selenophosphate.

Particularly preferred unstable type selenium compounds are as illustrated above, but the invention is not limited to these compounds.

The general understanding in the art with respect to unstable type selenium compounds as sensitizers for silver halide photographic emulsions is that the structure of the compound is not particularly important so long as the selenium is unstable. The general view of those skilled in the art is that the unstable selenium compound does not play any significant role except that the organic moiety of the selenium sensitizer molecule contains selenium and the sensitizer allows the selenium to be incorporated in the silver halide emulsion in an unstable form. In the context of the present invention, this means that a broad class of unstable selenium compounds can be used to advantage.

Selenium sensitization employing the stable type selenium sensitizers described in JP-B-46-4553, JP-B-52-34492, and JP-B-52-34491 can be used in the present invention. Stable type selenium compounds for use in the present invention include, for example, a selenious acid, potassium selenocyanate, selenazoles, quaternary ammonium salts of selenazoles, diaryl selenide, diaryl selenide, 2-thioselenazolidinedione, 2-selenoxaozolidinethione and their derivatives.

The stable type selenium sensitizers and the thioselenazolidinedione compounds described in JP-B-52-38408 can also be used effectively in the present invention.

The selenium sensitizer may be added to the silver halide emulsion in the form of an aqueous solution of the selenium sensitizer, or as a solution of the selenium sensitizer in an organic solvent such as methanol, ethanol, etc., or a mixture of such solvents. The selenium sensitizer is preferably added to the silver halide emulsion before the initiation of chemical sensitization. The selenium sensitizers may be used singly or in combination. It is preferred to use an unstable selenium compound and a stable selenium compound in combination.

The amount of the selenium sensitizer(s) to be added to the photographic material depends upon the activity of the selenium sensitizer being used, the kind and the size of the silver halide grains, and the temperature and time for ripening, but is preferably not less than $1\times10^{-8}$ mol, and more preferably from $1\times10^{-7}$ to $1\times10^{-5}$ mol per mol of the silver halide. The temperature of chemical ripening where a selenium sensitizer is used is preferably not lower than 45° C., and more preferably from 50° to 80° C. Also, the pAg and the pH of the silver halide emulsion during chemical ripening are not particularly limited. For example, the effects of the present invention can be obtained over a wide pH range of from 4 to 9.

The chemical sensitization is more effectively carried out in the presence of a silver halide solvent.

Silver halide solvents which can be used in the present invention include (a) the organic thioethers described in U.S. Pat. Nos. 3,271,157, 3,531,289, and 3,574,628, and in JP-A-54-1019 and JP-A-54-158917, (b) the thiourea derivatives described in JP-A-53-82408, JP-A-55-77737, and JP-A-55-2982, (c) silver halide solvents having a thiocarbonyl group between an oxygen atom or a sulfur atom and a nitrogen atom, (d) the imidazoles described in JP-A-54-100717, (e) sulfites, (f) thiocyanates, etc.

Particularly preferable silver halide solvents are thiocyanates and tetramethylthiourea.

The amount of the silver halide solvent to be used differs according to the kind of solvent but when, for example, a thiocyanate is used, the amount thereof is preferably from $1\times10^{-4}$ to $1\times10^{-2}$ mol per mol of the silver halide.

In the silver halide photographic emulsion for use in the present invention, a higher sensitivity and low fog can be attained by using a gold sensitization in the chemical sensitization step. If further sensitization is necessary, it is preferred to use a sulfur sensitization in combination with the gold sensitization.

The sulfur sensitization may be carried out by adding a sulfur sensitizer to the silver halide emulsion and stirring the emulsion at a high temperature (preferably not less than 40° C.) for a definite time.

Also, the gold sensitization is typically carried out by adding a gold sensitizer to the silver halide emulsion and stirring the emulsion at a high temperature (preferably higher than 40° C.) for a definite time.

Known sulfur sensitizers can be used for the sulfur sensitization. For example, suitable sulfur sensitizers include thiosulfates, allylthiocarbamidothiourea, allyl isocyanate, cystine, p-toluenesulfonates, rhodanine, etc. Also, the sulfur sensitizers described in U.S. Pat. Nos. 1,574,944 2,410,689, 2,278,947, 2,728,668, 3,501,313, and 3,656,955, in German Patent 1,422,869, and in JP-B-56-24937, and JP-A-55-45016 can be used in the present invention.

The amount of the sulfur sensitizer to be added to the photographic material should be an amount sufficient to effectively increase the sensitivity of the silver halide emulsion. The amount varies over a considerably wide range and is influenced by various conditions such as pH, temperature, size of the silver halide grains, etc., but is preferably from $1\times10^{-7}$ to $5\times10^{-5}$ mol per mol of the silver halide.

With regard to the gold sensitizer used for gold sensitization, the oxidation number of the gold may be plus monovalent or plus trivalent and gold compounds which are conventionally used as gold sensitizers can be used in the present invention. Typical examples of gold sensitizers include chloroaurates (e.g., potassium chloroaurate), auric trichloride, potassium auric thiocyanate, potassium iodoaurate, tetracyanoauric acid, ammonium aurothiocyanate, and pyridyl trichlorogold.

The amount of the gold sensitizer to be added to the photographic material depends upon various conditions but is preferably from $1\times10^{-7}$ to $5\times10^{-5}$ mol per mol of the silver halide.

With regard to chemical ripening, there are no particular restrictions on the time and the order of adding the silver halide solvent, the gold sensitizer being used together with the selenium sensitizer or the tellurium sensitizer, etc. For example, the foregoing compounds can be added to the silver halide emulsion simultaneously or separately, preferably at the beginning of chemical ripening or during chemical ripening. Also, when the foregoing compounds are added, they may be added as a solution thereof in water or as a solution thereof in an organic solvent miscible with water, such as methanol, ethanol, acetone, etc., used singly or as a mixture thereof.

With regard to the reduction sensitization method that may be used with the present invention, the reduction sensitization can be carried out using ascorbic acid, thiourea dioxide, stannous chloride, aminoiminomethanesulfinic acid, hydrazine derivatives, borane compounds, silane compounds, polyamine compounds, etc. Also, the silver halide emulsion can be reduction-sensitized by ripening the emulsion while keeping the pH of the emulsion of 7 or higher and the pAg of 8.3 or lower. Furthermore, the reduction sensitization can be carried out by introducing a single addition portion of a silver ion into the silver halide emulsion during the formation of the silver halide grains.

It is preferred to carry out the reduction sensitization of the silver halide emulsion using ascorbic acid or a derivative thereof or thiourea dioxide. These methods have less influence on the formation of the silver halide grains and the growth of the silver halide crystals. Also, these methods allow for greater control over the reduction sensitization process.

The amount of the reduction sensitizer to be used depends upon kinds of the reducing agent but is preferably from $1\times10^{-7}$ to $1\times10^{-2}$ mol per mol of the silver halide.

The reduction sensitization may be carried out in any step during the formation of the silver halide grains and may be carried out after the formation of the silver halide grains if it is done before the chemical sensitization.

As the tellurium sensitizer which may be used in the present invention, the compounds described in U.S. Pat. Nos. 1,623,499, 3,320,069, and 3,772,031, British Patents 235,211, 1,121,496, 1,295,462, and 1,396,696, Canadian Patent 800,958, *Journal of Chemical Society, Chemical Communication* 635 (1980), ibid., 1102 (1979), ibid., 645 (1979), *Journal of Chemical Society, Perkin Transaction*, Vol. 1 (1986) and Vol. 2 (1987), etc., can be preferably used.

Specific examples of suitable tellurium sensitizers are colloidal tellurium, telluroureas (e.g., allyltellurourea, N,N-dimethyltellurourea, tetramethyltellurourea, N-carboxyethyl-N',N'-dimethyltellurourea, N,N'-dimethyltellurourea, and N,N'-diphenylethylenetellurourea), isotellurocyanates (e.g., allyl isotellurocyanate), telluroketones (e.g., telluroacetone and telluroacetophenone), telluroamides (e.g., telluroacetamide and N,N-dimethyltellurobenzamide), tellurohydrazides (e.g., N,N',N'-trimethyltellurobenzhydrazide), telluroesters (e.g., t-butyl-t-hexyltelluroester), phosphine tellurides (e.g., tributylphosphine telluride, tricyclohexylphosphine telluride, triisopropylphosphine telluride, butyl-diisopropylphosphine telluride, and dibutylphenylphosphine telluride), and other tellurium compounds (e.g., gelatin containing a negatively charged telluride ion as described in British Patent 1,295,462, potassium telluride, potassium tellurocyanate, telluropentathionate sodium salt, and allyl tellurocyanate).

Among these tellurium compounds, preferred compounds are those represented by formulas (III) and (IV):

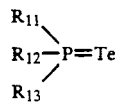

(III)

wherein $R_{11}$, $R_{12}$, and $R_{13}$ each represents an aliphatic group, an aromatic group, a heterocyclic group, $-OR_{14}$, $-NR_{15}(R_{16})$, $-SR_{17}$, $-OSiR_{18}(R_{19})(R_{20})$, X or a hydrogen atom; $R_{14}$ and $R_{17}$ each represents an aliphatic group, an aromatic group, a heterocyclic group, a hydrogen atom, or a cation; $R_{15}$ and $R_{16}$ each represents an aliphatic group, an aromatic group, a heterocyclic group, or a hydrogen atom; $R_{18}$, $R_{19}$, and $R_{20}$ each represents an aliphatic group; and X represents a halogen atom.

Formula (III) is described in detail below.

In formula (III), the aliphatic group represented by $R_{11}$, $R_{12}$, $R_{13}$, $R_{14}$, $R_{15}$, $R_{16}$, $R_{17}$, $R_{18}$, $R_{19}$, and $R_{20}$ is preferably an aliphatic group having from 1 to 30 carbon atoms, and particularly preferably a straight chain, branched or cyclic alkyl group having from 1 to 20 carbon atoms, an alkenyl group, an alkinyl group, or an aralkyl group. Examples of the alkyl group, the alkenyl group, the alkinyl group, and the aralkyl group include, for example, methyl, ethyl, n-propyl, isopropyl, t-butyl, n-octyl, n-decyl, n-hexadecyl, cyclopentyl, cyclohexyl, allyl, butenyl, 3-pentenyl, propargyl, 3-pentyl, benzyl, and phenetyl.

In formula (III), the aromatic group represented by $R_{11}$, $R_{12}$, $R_{13}$, $R_{14}$, $R_{15}$, $R_{16}$, and $R_{17}$ is preferably an aromatic group having from 6 to 30 carbon atoms, and particularly preferably a monocyclic or a condensed aryl group having from 6 to 20 carbon atoms, such as phenyl, naphthyl, etc.

In formula (III), the heterocyclic group represented by $R_{11}$, $R_{12}$, $R_{13}$, $R_{14}$, $R_{15}$, R16, and $R_{17}$ is preferably a 3- to 10-membered saturated or unsaturated heterocyclic group containing at least one of a nitrogen atom, an oxygen atom, and a sulfur atom. The heterocyclic group may be a monocyclic ring or may form a condensed ring with an aromatic ring or a heterocyclic ring. Particularly preferred heterocyclic groups include 5-membered or 6-membered aromatic heterocyclic groups such as pyridyl, furyl, thienyl, thiazolyl, imidazolyl, benzimidazolyl, etc.

In formula (III), the cation represented by $R_{14}$ and $R_{17}$ is, for example, an alkali metal ion or an ammonium ion.

In formula (III), the halogen atom represented by X is, for example, fluorine, chlorine, bromine, or iodine.

Furthermore, the foregoing aliphatic group, aromatic group, and heterocyclic group each may be substituted with a substituent such as, for example, an alkyl group, an aralkyl group, an alkenyl group, an alkinyl group, an aryl group, an alkoxy group, an aryloxy group, an amino group, an acylamino group, a ureido group, a urethane group, a sulfonylamino group, a sulfamoyl group, a carbamoyl group, a sulfonyl group, a sulfinyl group, an alkyloxycarbonyl group, an aryloxycarbonyl group, an acyl group, an acyloxy group, a phosphoric acid amido group, a diacylamino group, an imido group, an alkylthio group, an arylthio group, a halogen atom, a cyano group, a sulfo group, a carboxy group, a hydroxy group, a phosphono group, a nitro group, or a heterocyclic group. These groups may be further substituted. When two or more substituents are present, they may be the same or different.

In formula (III), $R_{11}$, $R_{12}$, and $R_{13}$ may bond together to form a ring with a phosphorus atom. Further, $R_{15}$ and $R_{16}$ may bond with each other to form a nitrogen-containing heterocyclic ring.

In formula (III), $R_{11}$, $R_{12}$, and $R_{13}$ each preferably represents an aliphatic group or an aromatic group, and more preferably represents an alkyl group or an aromatic group.

Formula (IV) is set forth below:

$$R_{21}-\overset{\overset{\displaystyle Te}{\|}}{C}-R_{22} \qquad \text{(IV)}$$

wherein $R_{21}$ represents an aliphatic group, an aromatic group, a heterocyclic group, or $-NR_{23}(R_{24})$; $R_{22}$ represents $-NR_{25}(R_{26})$, $-N(R_{27})N(R_{28})R_{29}$, or $-OR_{30}$, wherein $R_{23}$, $R_{24}$, $R_{25}$, $R_{26}$, $R_{27}$, $R_{28}$, $R_{29}$ and $R_{30}$ each represents a hydrogen atom, an aliphatic group, an aromatic group, a heterocyclic group or an acyl group, and wherein $R_{21}$ and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, or $R_{23}$ and $R_{30}$ may bond with each other to form ring.

Formula (IV) is described in detail below.

In formula (IV), the aliphatic group represented by $R_{21}$, $R_{23}$, $R_{24}$, $R_{25}$, $R_{26}$, $R_{27}$, $R_{28}$, $R_{29}$ and $R_{30}$ is preferably an aliphatic group having from 1 to 30 carbon atoms, and particularly preferably a straight chain, branched or cyclic alkyl group having from 1 to 20 carbon atoms, an alkenyl group, an alkinyl group, or an aralkyl group. Examples of the alkyl group, the alkenyl group, the alkinyl group, and the aralkyl group include, for example, methyl, ethyl, n-propyl, isopropyl, t-butyl, n-octyl, n-decyl, n-hexadecyl, cyclopentyl, cyclohexyl, allyl, 2-butenyl, 3-pentenyl, propargyl, 3-pentinyl, benzyl, and phenetyl.

In formula (IV), the aromatic group represented by $R_{21}$, $R_{23}$, $R_{24}$, $R_{25}$, $R_{26}$, $R_{27}$, $R_{28}$, $R_{29}$ and $R_{30}$ is preferably an aromatic group having from 6 to 30 carbon atoms, and particularly preferably a monocyclic or condensed aryl group having from 6 to 20 carbon atoms, such as, for example, phenyl and naphthyl.

In formula (IV), the heterocyclic group represented by $R_{21}$, $R_{23}$, $R_{24}$, $R_{25}$, $R_{26}$, $R_{27}$, $R_{28}$, $R_{29}$ and $R_{30}$ is preferably a 3- to 10-membered saturated or unsaturated heterocyclic ring containing at least one of a nitrogen atom, an oxygen atom, and a sulfur atom. The heterocyclic group may be a monocyclic ring or it may form a condensed ring with an aromatic ring or a heterocyclic ring. The heterocyclic group is preferably a 5-membered or 6-membered aromatic heterocyclic group such as, for example, pyridyl, furyl, thienyl, thiazolyl, imidazolyl, or benzimidazolyl.

In formula (IV), the acyl group represented by $R_{23}$, $R_{24}$, $R_{25}$, $R_{26}$, $R_{27}$, $R_{28}$, $R_{29}$ and R30 is preferably an acyl group having from 1 to 30 carbon atoms, and particularly preferably a straight chain or branched acyl group having from 1 to 20 carbon atoms, such as, for example, acetyl, benzoyl, formyl, pivaloyl, or decanoyl.

When $R_{21}$ and $R_{25}$, $R_{21}$ and $R_{27}$, $R_{21}$ and $R_{28}$, $R_{21}$ and $R_{30}$, $R_{23}$ and $R_{25}$, $R_{23}$ and $R_{27}$, $R_{23}$ and $R_{28}$, or $R_{23}$ and $R_{30}$ bond with each other to form a ring, suitable groups for $R_{21}$, $R_{23}$, $R_{25}$, $R_{27}$, $R_{28}$ and $R_{30}$ include an alkylene group, an arylene group, an aralkyl group, and an alkenylene group.

Also, the foregoing aliphatic group, aromatic group, and heterocyclic group each may be substituted with one or more substituents as described above in regard to formula (III).

In formula (IV), $R_{21}$ preferably represents an aliphatic group, an aromatic group, or $-NR_{23}(R_{24})$; and $R_{22}$ preferably represents $-NR_{25}(R_{26})$, wherein $R_{23}$, $R_{24}$, $R_{25}$, and $R_{26}$ each represents an aliphatic group or an aromatic group.

In formula (IV), $R_{21}$ particularly preferably represents an aromatic group or $-NR_{23}(R_{24})$; and $R_{22}$ particularly preferably represents $-NR_{25}(R_{26})$, wherein $R_{23}$, $R_{24}$, $R_{25}$, and $R_{26}$ each represents an alkyl group or an aromatic group. In this case, it is particularly preferred that $R_{21}$ and $R_{25}$, and $R_{23}$ and $R_{25}$, form a ring together with an alkylene group, an arylene group, an aralkylene group, or an alkenylene group.

Specific examples of compounds represented by formulas (III) and (IV) are illustrated below but the invention is not limited to these compounds.

Specific Examples Of Compounds Represented By Formula (III)

$(nC_4H_9)_3P{=}Te$ III-1.

$(tC_4H_9)_3P{=}Te$ III-2.

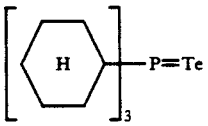
III-3.

$((i)C_3H_7)_3P{=}Te$ III-4.

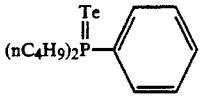
III-5.

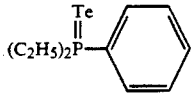
III-6.

$((i)C_4H_9)_3P{=}Te$ III-7.

$((i)C_4H_9)_2\overset{\overset{Te}{\|}}{P}C_4H_9(n)$ III-8.

$(i)C_3H_7\overset{\overset{Te}{\|}}{P}(C_4H_9(n))_2$ III-9.

$((i)C_3H_7)_2\overset{\overset{Te}{\|}}{P}(C_4H_9(n))$ III-10.

$(i)C_3H_7\overset{\overset{Te}{\|}}{P}(C_4H_9(i))_2$ III-11.

$((i)C_3H_7)_2\overset{\overset{Te}{\|}}{P}C_4H_9(i)$ III-12.

$((i)C_3H_7)_2\overset{\overset{Te}{\|}}{P}C_8H_{17}(n)$ III-13.

$C_2H_5\overset{\overset{Te}{\|}}{P}(OC_2H_5)_2$ III-14.

$(n\text{-}C_4H_9)_3P{=}Te$ III-15.

$C_2H_5\overset{\overset{Te}{\|}}{P}{\leftarrow}N(CH_3)_2)_2$ III-16.

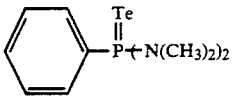
III-17.

$((CH_3)_2N)_3P{=}Te$ III-18.

-continued

Specific Examples Of Compounds Represented By Formula (III)

$((CH_3)_3SiO)_2\overset{\overset{Te}{\|}}{P}H$ III-19.

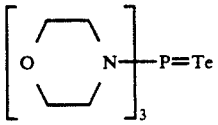
III-20.

$(C_2H_5)_2\overset{\overset{Te}{\|}}{P}N(C_2H_5)_2$ III-21.

$H_2\overset{\overset{Te}{\|}}{P}NH_2$ III-22.

Specific Examples Of Compounds Represented By Formula (IV)

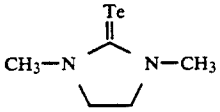
IV-1.

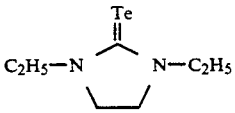
IV-2.

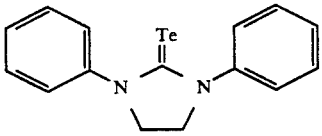
IV-3.

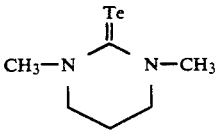
IV-4.

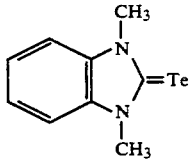
IV-5.

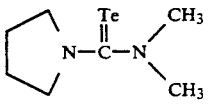
IV-6.

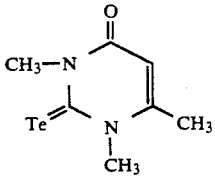
IV-7.

-continued

Specific Examples Of Compounds Represented By Formula (IV)

IV-8.

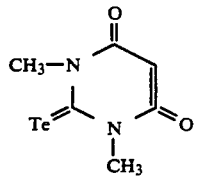

IV-9.

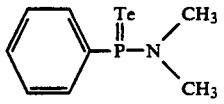

IV-10.

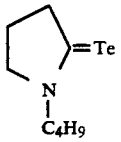

IV-11.

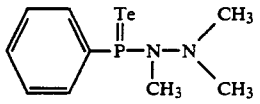

IV-12.

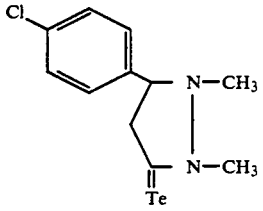

IV-13.

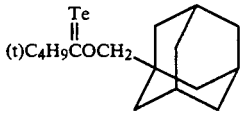

IV-14.

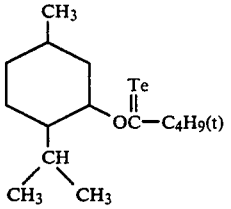

IV-15.

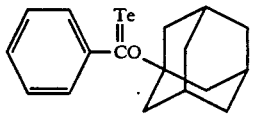

IV-16.

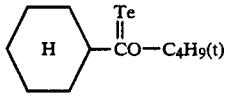

The compounds represented by formulas (III) and (IV) for use in the present invention can be synthesized using known methods. For example, these compounds can be synthesized by the methods described in *Journal of Chemical Society (A)*, 2927 (1969), *Journal of Organometallic Chemistry*, 4320 (1965), ibid., 1200 (1963), ibid., 113.C35 (1976), *Phosphorus Sulfur*, 15, 155 (1983), *Chem. Ber.*, 109, 2996 (1976), *Journal of Chemical Society, Chemical Communication*, 635 (1980), ibid., 1102 (1979), ibid., 645 (1979), ibid., 820 (1987), *Journal of Chemical Society, Perkin Transaction*, 1, 2191 (1980), and *The Chemistry of Organo Selenium and Tellurium Compounds*, Vol. 2, 216–267 (1987).

The amount of the tellurium sensitizer to be used in the photographic material of the invention differs according to kinds of the silver halide grains being used, the chemical ripening conditions, etc., but is generally from $1\times10^{-8}$ to $1\times10^{-2}$ mol, and preferably from $1\times10^{-7}$ to $5\times10^{-3}$ mol per mol of silver halide.

There is no particular restriction on the conditions for the chemical sensitization to be used in the present invention but the pAg is typically from 6 to 11, and preferably from 7 to 10, and the temperature is typically from 40° C. to 95° C., and preferably from 45° C. to 85° C.

In the present invention, it is preferable to use a noble metal sensitizer such as gold, platinum, palladium, iridium, etc., together with the tellurium sensitization. The use of a gold sensitizer together with the tellurium sensitization is particularly prefer red. Examples of suitable gold sensitizers include chloroauric acid, potassium chloroaurate, potassium aurithiocyanate, gold sulfide, gold selenide, etc. The gold sensitizer is typically used in an amount of from about $1\times10^{-7}$ to $1\times10^{-2}$ mol per mol of the silver halide.

In the present invention, it is further preferable to use a sulfur sensitizer. Examples of suitable sulfur sensitizers include unstable sulfur compounds such as thiosulfates (e.g., hypo), thioureas (e.g., diphenylthiourea, triethylurea, and allylthiourea), and rhodanines. The sulfur sensitizer is typically used in an amount of from about $1\times10^{-7}$ to $1\times10^{31\ 2}$ mol per mol of the silver halide.

Tabular silver halide grains which can preferably be used in the present invention are described below.

The aspect ratio (diameter/thickness ratio) of the tabular silver halide grains for use in the present invention is preferably at least 3, more preferably from 5 to 100, even more preferably from 5 to 50, and most preferably from 7 to 20.

The diameter of the tabular silver halide grains is defined as the diameter of a circle having the same area as the projected area of the silver halide grain. In the present invention, the diameter of the tabular silver halide grains is preferably from 0.5 to 10 μm, more preferably from 0.5 to 5.0 μm, and most preferably from 1.0 to 4.0 μm.

In general, a tabular silver halide grain has a tabular form having two parallel planes and hence the "thickness" of the tabular silver halide grain in the context of the present invention is defined as the distance between the two parallel planes constituting the tabular silver halide grain.

The halogen composition of the tabular silver halide grains is preferably silver bromide or silver iodobromide and is particularly preferably silver iodobromide having a silver iodide content of from 0 to 10 mol %.

Methods for producing the tabular silver halide grains are described below.

The tabular silver halide grains can be produced by using one or more methods known in the art.

For example, tabular silver halide grains can be obtained by forming seed crystals of which at least 40% by weight are tabular grains under conditions of a relatively high pAg value and a pBr of not higher than 1.3, and then growing the seed crystals by simultaneously adding an aqueous silver nitrate solution and an aqueous halide solution to the system while maintaining the pBr value nearly constant.

It is desirable that in the step of growing the silver halide grains, the aqueous solution of silver nitrate and the aqueous halide solution are added such that new crystal nuclei do not form.

The size of the tabular silver halide grains can be controlled by adjusting the temperature, suitably selecting the kind and the amount of the solvent being used, and controlling the addition rates of the aqueous silver salt solution and the aqueous halide solution being used to grow the silver halide grains.

The form (the aspect ratio, etc.) of the silver halide grains, the grain size distribution of the silver halide grains, and the growing speed of the silver halide grains can be controlled by using, if necessary, a silver halide solvent during the production of the tabular silver halide grains for use in the present invention. The amount of the silver halide solvent is preferably from $1\times10^{-3}$ to 1.0% by weight, and particularly preferably from $1\times10^{-2}$ to $1\times10^{-1}$% by weight of the reaction solution.

For example, by increasing the amount of the silver solvent, a monodisperse grain size distribution can be obtained and the growing speed of the silver halide grains can be increased. At the same time, however, the thickness of the tabular grains tends to increase as the amount of the silver halide solvent increases.

Suitable silver halide solvents include ammonia, thioethers, and thioureas. Suitable thioethers are described in U.S. Pat. Nos. 3,271,157, 3,790,387, 3,574,628, and elsewhere in the patent literature.

Preferred methods for accelerating the growth of the silver halide grains include methods of increasing the addition rate, the addition amounts, or the addition concentrations of the aqueous silver salt solution (e.g., an aqueous silver nitrate solution) and the aqueous halide solution (e.g., an aqueous potassium bromide solution) used in the production of the tabular silver halide grains. Such methods are described in British Patent 1,335,925, U.S. Pat. Nos. 3,672,900, 3,650,757, and 4,242,445, JP-A-55-142329, JP-A-55-158124, and elsewhere in the patent literature.

The tabular silver halide grains for use in the present invention can be, if necessary, chemically sensitized with a compound other than selenium, tellurium, and sulfur.

As a chemical sensitizing method, a so-called gold sensitizing method using a gold compound as described, e.g., in U.S. Pat. Nos. 2,448,060 and 3,320,069, or a sensitizing method using another noble metal such as iridium, platinum, rhodium, palladium, etc., as described, e.g., in U.S. Pat. Nos. 2,448,060, 2,566,245, and 2,566,263, can be used.

It is preferable that in the layer containing the tabular silver halide grains for use in the present invention, the tabular silver halide grains having an aspect ratio of at least 3 are contained in a percent of at least 50%, and particularly at least 60% by weight of the total silver halide grains.

The thickness of the layer containing the tabular silver halide grains is preferably from 0.3 to 5.0 μm, and particularly preferably from 0.5 to 3.0 μm.

Also, the coating amount (for one side of the support) of the tabular silver halide grains is preferably from 0.5 to 6 g/m$^2$, and more preferably from 1 to 4 g/m$^2$.

Other components which may be used in the layer containing the tabular silver halide grains for use in the present invention, such as a binder, a hardening agent, an antifoggant, a stabilizer for the silver halide, a surfactant, a spectral sensitizing dye, a dye, an ultraviolet absorbent, a chemical sensitizer, etc., are described, e.g., in *Research Disclosure*, Vol. 176, pages 22 to 28 (December, 1978), and they can be used in the pages present invention without particular restriction.

The silver halide emulsion layer of the silver halide photographic material of the present invention can further contain ordinary silver halide grains in addition to the tabular silver halide grains. Such silver halide grains can be prepared using the methods described, e.g., in P. Glafkides, *Chimie et Physique Photographique* (published by Paul Montel Co., 1967), G. F. Duffin, *Photographic Emulsion Chemistry* (published by The Focal Press, 1966), V. L. Zelikman et al, *Making and Coating Photographic Emulsions* (published by The Focal Press, 1964), etc. That is, an acidic method, a neutralization method, an ammonium method, etc., may be used and as the system for reacting the soluble silver salt and the soluble halide, a single jet method, a double jet method, or a combination thereof may be used.

A so-called reverse mixing method, i.e., a method for forming the silver halide grains in the presence of excessive silver ions, can be used. Further, as one type of double jet method, a double jet method in which a constant pAg is maintained in the liquid phase while forming the silver halide grains can be used.

As the silver halide, silver bromide, silver iodobromide, silver iodochlorobromide, silver chlorobromide, silver chloride, etc., can be used.

In the step for forming the silver halide grains or during physical ripening of the silver halide grains, a cadmium salt, a zinc salt, a lead salt, a thallium salt, an iridium salt or complex salts thereof, a rhodium salt or complex salts thereof, or an iron salt or complex salts thereof may be used alone or in combination. Also, if necessary, the silver halide grains can be subjected to a chemical sensitization as in the case of the foregoing tabular silver halide grains.

In the silver halide photographic emulsion for use of the present invention, various compounds can be included to inhibit the formation of fog during the production, storage or photographic processing of the silver halide photographic material or to stabilize the photographic performance thereof. That is, various compounds known as antifoggants or stabilizers can be included in the emulsion, such as azoles [e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenztriazoles, and mercaptotetrazoles (in particular, 1-phenyl-5-mercaptotetrazole)]; mercaptopyrimidines; azaindenes [e.g., triazaindenes, tetraazaindenes (in particular, 4-hydroxy-substituted (1,3,3a, 7)tetraazaindenes), and pentaazaindenes]; benzenethiosulfonic acid; benzenesulfinic acid; benzenesulfonic acid amide, etc. Suitable examples of antifoggants and stabilizers are described in U.S. Pat. Nos. 3,954,474 and 3,982,947 and JP-B-52-28660.

There is no particular restriction on the use of other various additives in the silver halide photographic material of the present invention and, for example, the compounds and the methods described in the following portions of JP-A-2-68539 can be used.

| Emulsion, Additive, Method, etc. | Described At: |
|---|---|
| 1. Silver Halide Emulsion and the Production Method: | JP-A-2-68539, page 8, right lower column, line 6 from the bottom to page 10, right upper column, line 12. |
| 2. Chemical Sensitizing Method: | Id., page 10, right upper column, line 13 to left lower column, line 16. |
| 3. Antifoggant and Stabilizer: | Id., Page 10, left lower column, line 17 to page 11, left upper column, line 7 and page 3, left lower column, line 2 to page 4, left lower column. |
| 4. Spectral Sensitizing Dye: | Id., page 4, right lower column, line 4 to page 8, right lower column. |
| 5. Surfactant and Antistatic Agent: | Id., page 11, left upper column, line 14 to page 12, left upper column, line 9. |
| 6. Matting Agent, Sliding Agent, and Plasticizers: | Id., page 12, left upper column, line 10 to right upper column, line 10 and page 14, left lower column, line 10 to right lower column, line 1. |
| 7. Hydrophilic Colloid: | Id., page 12, right upper column, line 11 to left lower column, line 16. |
| 8. Hardening Agent: | Id., page 12, left lower column, line 17 to page 13, right upper column, line 6. |
| 9. Support: | Id, page 13, right upper column, line 7 to line 20. |
| 10. Dye and Mordant: | Id., page 13, left lower column, line 1 to page 14, left lower column, line 9. |
| 11. Developing Process: | JP-A-2-103037, page 16, right upper column, line 7 to page 19, left lower column, line 15, and JP-A-2-115837, page 3, right lower column, line 5 to page 6, right upper column, line 10. |

The following examples are intended to illustrate the present invention in more detail but not to limit it in any way.

EXAMPLE 1

Preparation of Emulsions T-1 to T-8

4.5 g of potassium bromide, 20,6 g of gelatin and 2.5 ml of an aqueous solution of 5% thioether, $HO(CH_2)_2S(CH_2)_2S(CH_2)_2OH$, were added to 1 liter of water in a reaction vessel. This mixture was maintained at 60° C. in the reaction vessel while 37 ml of an aqueous silver nitrate solution (3.43 g of silver nitrate) and 33 ml of an aqueous solution containing 2.97 g of potassium bromide and 0.363 g of potassium iodide were added using a double jet method over a period of 37 seconds. Then, an aqueous solution of 0.9 g of potassium bromide was added to the mixture. The temperature was raised to 70° C., and 53 ml of an aqueous silver nitrate solution (4.90 g of silver nitrate) were added to the mixture over a period of 13 minutes. Then, 15 ml of an aqueous 25% ammonium solution were added to the mixture and after carrying out physical ripening for 20 minutes at the same temperature, 14 ml of a 100% acetic acid solution were added. Thereafter, the mixture was divided into four equal portions and an aqueous solution of 133.3 g of silver nitrate and an aqueous solution of potassium bromide were added to each mixture portion while maintaining a pAg of 8.5 using a controlled double jet method over a period of 35 minutes. Simultaneous to the addition of the aqueous potassium bromide, an aqueous potassium iodide solution was added to each mixture portion in a KI amount of 0.00 mol %, 0.05 mol %, 1 mol %, or 3 mol % based on the total silver amount, respectively, to provide four silver halide emulsions.

After finishing the foregoing addition, 15 ml of an aqueous solution of 2N potassium thiocyanate were added to each emulsion. Thereafter, the temperature of each emulsion was lowered to 35° C. and the soluble salts were removed using a flocculation method. Subsequently, the temperature of each emulsion was raised to 40° C., and after adding thereto 35 g of gelatin, 2.5 g of phenoxy ethanol, and a thickener, the pH and the pAg of each emulsion were adjusted to 6.1 and 8.3, respectively, using an aqueous sodium hydroxide solution, an aqueous potassium bromide solution, and an aqueous silver nitrate solution.

The temperature of each emulsion thus-prepared was raised to 56° C., and 735 mg of Sensitizing Dye I-4 of the present invention were added to each emulsion. Further, 8 mg of Sensitizing Dye II-8 of the present invention were added to each emulsion. The emulsions were allowed to stand for 10 minutes and then 3.3 mg of sodium thiosulfate, 2.6 mg of chloroauric acid, and 110 mg of potassium thiocyanate were added to each emulsion. After ripening each emulsion for 60 minutes, each emulsion was solidified by rapid cooling to obtain silver halide emulsions T-1 to T-4.

Silver Halide Emulsions T-5 to T-8 were prepared using the same procedure as above except that Sensitizing Dye II-8 was not added.

Emulsions T-1 to T-8 thus-prepared are shown in Table 1 below:

TABLE 1

| Emulsion | Content of Iodine (mol %) | Sensitizing Dye II-8 |
|---|---|---|
| T-1 | 0.26 | Used |
| T-2 | 0.76 | Used |
| T-3 | 1.25 | Used |
| T-4 | 3.26 | Used |
| T-5 | 0.26 | Not Used |
| T-6 | 0.76 | Not Used |
| T-7 | 1.26 | Not Used |
| T-8 | 3.26 | Not Used |

Note:
Emulsions T-1 and T-2 are silver halide emulsions of the present invention. The others are comparative emulsions.

For each of Silver Halide Emulsions T-1 to T-8, 93% of the silver halide grains were tabular silver halide grains having an aspect ratio of at least 3, as determined by the sum total of the projected area of all the grains. The mean projected area diameter of all the silver halide grains having an aspect ratio of at least 3 was 1.4 microns, the standard deviation was 20%, the mean thickness was 0.2 μm, and the mean aspect ratio was 7.

Preparation of Coating Compositions

To each of silver halide emulsions T-1 to T-8 thus-prepared, the following components were added in the amounts shown below per mol of silver halide to prepare coating compositions:

| | |
|---|---|
| 4-Hydroxy-6-methyl-1,3,3a,7-tetra-azaindene | 1.94 g |
| 2,6-Bis(hydroxyamino)-4-diethylamino-1,3,5-triazine | 80 mg |
| Sodium Polyacrylate (average molecular weight 41,000) | 4.0 g |

Preparation of Coating Composition for Surface Protective Layer

An aqueous solution containing gelatin, dextran having an average molecular weight of 40,000, polymethyl methacrylate fine particles (mean particle size 3.0 μm), polyethylene oxide, and sodium polyacrylate (average molecular weight 41,000) was prepared as a coating composition for a surface protective layer.

Coating of Samples

The coating composition of each of silver halide emulsion T-1 to T-8 and the foregoing coating composition for the surface protective layer were simultaneously coated on one surface of a polyethylene terephthalate support by an extrusion method and then dried to provide eight silver halide photographic materials designated Sample Nos. 1 to 8.

In each of Sample Nos. 1 to 8, the coated silver amount was 3.3 g/m$^2$. In the surface protective layer, the coated amount of gelatin was 0.8 g/m$^2$ and the coated amount of dextran was 0.8 g/m$^2$.

In addition, during 1,2-bis(sulfonylacetamido)ethane was added to each emulsion in an amount of 8 mmol per 100 g of gelatin as a hardening agent.

Exposure and Processing

Each of Sample Nos. 1 to 8 was exposed to green light for 1/20 second. Each sample was then developed with Developer (I) having the following composition for 8 seconds or 24 seconds at 35° C., fixed, washed, and dried.

| Developer (I): | |
|---|---|
| 1-Phenyl-3-pyrazolidone | 1.5 g |
| Hydroquinone | 30 g |
| 5-Nitroindazole | 0.25 g |
| Potassium Bromide | 3.0 g |
| Anhydrous Sodium Sulfite | 50 g |
| Potassium Hydroxide | 30 g |
| Boric Acid | 5 g |
| Glutaraldehyde | 10 g |
| Water to make | 1 liter |
| pH adjusted to | 10.20 |

Evaluation of Samples

The sensitivity of each of Samples 1 to 8 was calculated as the reciprocal of the exposure amount giving a density of fog +1.0, where the sensitivity of Sample No. 5 developed for 24 seconds was defined as 100.

The results obtained are given in Table 2 below.

TABLE 2

| Sample No. | Sensitivity when Processed for 8 Seconds | Sensitivity when Processed for 24 Seconds |
|---|---|---|
| 1 | 100 | 160 |
| 2 | 90 | 145 |
| 3 | 55 | 115 |
| 4 | 60 | 110 |
| 5 | 50 | 100 |
| 6 | 45 | 105 |
| 7 | 50 | 110 |
| 8 | 45 | 105 |

(Note):
Sample Nos. 1 and 2 are samples of the present invention. Sample Nos. 3 to 8 are comparative samples.

The results in Table 2 show that when the dyes of formulas (I) and (II) of the present invention are used in combination with a silver halide emulsion having an iodine content of 1 mol % or less, the resulting photographic material is highly sensitized and this high sensitivity is maintained even when development is carried out in a very short time.

EXAMPLE 2

Preparation of Emulsions

The same procedure used to prepare each of silver halide emulsions T-1 to T-4 in Example 1 was repeated except that 8 mg of Sensitizing Dye II-9 of the present invention was added in place of Sensitizing Dye II-8 before the chemical sensitization. Also, the chemical sensitization was carried out using each of the compounds shown in Table 3 below in place of the sodium thiosulfate used as a sulfur sensitizer in Example 1. The resulting silver halide emulsions were designated emulsions T-9 to T-16.

TABLE 3

| Emulsion | Content of Iodine (mol %) | Chemical Sensitizer |
|---|---|---|
| T-9 | 0.26 | Selenium Sensitizer (shown below) 2.7 mg; Sodium Thiosulfate 1.17 mg |
| T-10 | 0.26 | Tellurium Sensitizer III-12; Sodium Thiosulfate 1.7 mg |
| T-11 | 0.76 | Same as in T-9 |
| T-12 | 0.76 | Same as in T-10 |
| T-13 | 1.26 | Same as in T-9 |
| T-14 | 1.26 | Same as in T-10 |
| T-15 | 3.26 | Same as in T-9 |
| T-16 | 3.26 | Same as in T-10 |

Note:
Emulsions T-9 to T-12 are silver halide emulsions of the present invention. Emulsions T-13 to T-16 are comparative emulsions.
Selenium Sensitizer

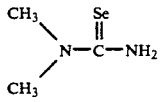

Preparation of Coating Compositions

To each of the silver halide emulsions T-9 to T-16 thus-prepared, the following components were added to prepare coating compositions.

| Component | Amount per Mol of Silver Halide |
|---|---|
| 4-Hydroxy-6-methyl-1,3,3a,7-tetra-azaindene | 1.94 g |
| 2,6-Bis(hydroxyamino)-4-diethylamino-1,3,5-triazine | 80 mg |
| Sodium Polyacrylate (average molecular weight 41,000) | 4.0 g |
| Colloidal Silica (Snow Tex C, trade name, made by Nissan Chemical Industries, Ltd.) | 10 g |
| 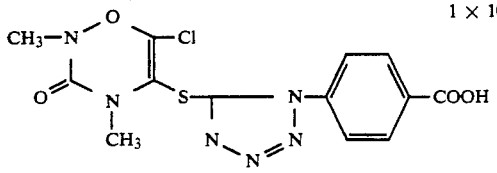 | $1 \times 10^{-3}$ mol |

Preparation of Coating Composition for Surface Protective Layer:

-continued

| Component | Amount per Mol of Silver Halide |
|---|---|
| Sodium Polystyrenesulfonate (average molecular weight: 600,000) | 0.01 g/m$^2$ |
| Hardening Agent: | |
| 1,2-Bis(vinylsulfonylacetamide)ethane | |
| (The addition amount was adjusted such that the swelling ratio became the value of 230%.) | |
| 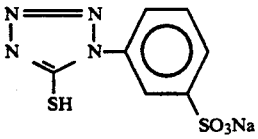 | 0.0005 g/m$^2$ |
| Gelatin | 0.966 g/m$^2$ |
| Sodium Polyacrylate (average molecular weight: 400,000) | 0.023 g/m$^2$ |
| 4-Hydroxy-6-methyl-1,3,3a,7-tetraazaindene | 0.015 g/m$^2$ |
| 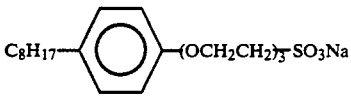 | 0.013 g/m$^2$ |
| $C_{16}H_{33}O-(CH_2CH_2O)_{10}H$ | 0.045 g/m$^2$ |
| $C_{17}H_{33}CON(CH_3)CH_2CH_2SO_3Na$ | 0.0065 g/m$^2$ |
| $C_8H_{17}SO_2N(C_3H_7)-(CH_2CH_2O)_{15}H$ | 0.003 g/m$^2$ |
| $C_8H_{17}SO_2N(C_3H_7)-(CH_2CH_2O)_4(CH_2)_4SO_3Na$ | 0.001 g/m$^2$ |
| Polymethyl Methacrylate (average particle size: 3.7 μm) | 0.087 g/m$^2$ |
| Proxel (pH adjusted to 7.4 with NaOH) | 0.0005 g/m$^2$ |

Preparation of Support

(1) Preparation of Dye Dispersion for Subbing Layer

The dye shown below was treated in a ball mill using the method described in JP-A-63-197943:

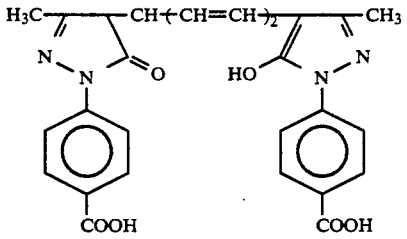

434 ml of water and 791 ml of a 6.7 weight percent aqueous solution of a surfactant Triton X-200 (TX-200, trade name, manufactured by Rohm & Haas Co.) were placed in a two-liter ball mill and then 20 g of the foregoing dye were added to the solution. Then, after adding 400 ml of zirconium oxide (ZrO) beads (diameter: 2 mm) to the mixture, the contents were milled for 4 days. Thereafter, 160 g of a 12.5 weight % aqueous solution of gelatin were added to the ball mill. Then, after defoaming, the ZrO beads were removed using a filter to obtain a dye dispersion.

The dye particles in the dye dispersion thus obtained had a wide range of diameters, ranging from 0.05 μm to 1.15 μm. The mean particle size was 0.37 μm.

Further, dye particles having a diameter of 0.9 μm or more were removed by a centrifugation method.

(2) Preparation of Support

After applying a corona discharge treatment to a biaxially stretched polyethylene terephthalate film of 183 μm in thickness, a first subbing solution having the following composition was coated on one side thereof using a wire bar coater to obtain a coverage of 5.1 ml/m$^2$ and then dried for one minute at 175° C.

Then, the first subbing solution was also coated on the opposite surface of the film.

The polyethylene terephthalate film used as a support contained 0.04% by weight of a dye having the following structure:

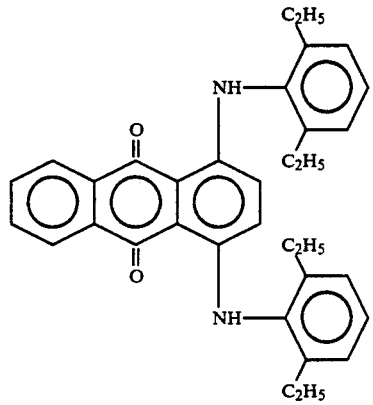

The composition of the first subbing solution is given below:

| Composition of First Subbing Solution: | |
|---|---|
| Butadiene-styrene copolymer latex Solution (solid components: 40%; butadiene/styrene weight ratio = 31/69) | 79 ml |
| 2,4-Dichloro-6-hydroxy-s-triazine Sodium Salt 4% Solution | 20.5 ml |
| Distilled Water | 900.5 ml |

This latex solution further contained the emulsion dispersing agent shown below in an amount of 0.4% by weight based on the weight of the solid components in the latex:

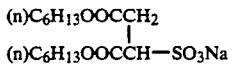

Then, the coating composition for the second subbing layer was coated on top of the first subbing layer on each side of the support using a wire bar coater and dried at 150° C.

The composition of the second subbing layer is given below:

| Composition of Second Subbing Layer: | |
|---|---|
| Gelatin | 160 mg/m$^2$ |
| Dye Dispersion (as dye-solid components) | 26 mg dye/m$^2$ |
| 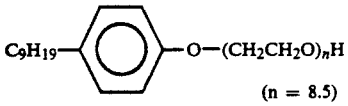 (n = 8.5) | 8 mg/m$^2$ |
| 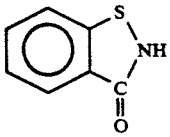 | 0.27 mg/m$^2$ |
| Matting agent | |
| Polymethyl methacrylate particles (average particle size: 2.5 μm) | 2.5 mg/m$^2$ |

Then, the coating composition for each of Silver Halide Emulsions T-9 to T-16 and the coating composition for the surface protective layer were simultaneously coated on both the surfaces of the support prepared as described above using an extrusion method and dried to provide silver halide photographic materials designated Sample Nos. 9 to 16.

On each of the samples, the coated silver amount was 3.3 g/m$^2$, and in the surface protective layer, the coated gelatin amount was 0.8 g/m$^2$ and the coated amount of dextran was 0.8 g/m$^2$. In addition, during coating, 1,2-bis(sulfonylacetamido)ethane was added to the silver halide emulsion as a hardening agent in an amount of 8 mmol per 100 g of gelatin. The weight ratio of silver to the binder in each sample was 1.1.

Each of these samples thus-prepared was exposed from both sides for 0.05 seconds using an X-ray Ortho Screen HR-4 (trade name, made by Fuji Photo Film Co., Ltd.).

After being exposed, each sample was processed as described below.

Processing

A Konica Corporation SRX 501 Automatic Processor was used to process the samples. The driving motor and the gear portions of the processor were modified such that the transporting speed was increased.

The following processing solutions were used:

| Concentrated Developer: | |
|---|---|
| Potassium Hydroxide | 56.6 g |
| Sodium Sulfite | 200 g |
| Diethylenetriamine.Penta-acetate | 6.7 g |
| Potassium Carbonate | 16.7 g |
| Boric Acid | 10 g |
| Hydroquinone | 83.3 g |
| Diethylene Glycol | 40 g |
| 4-Hydroxymethyl-4-methyl-1-phenyl-3-pyrazolidone | 22.0 g |
| 5-Methylbenzotriazole | 2 g |
| 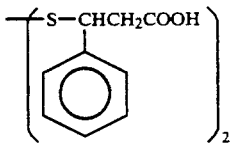 | 0.6 g |
| Water to make | 1 liter |
| pH adjusted to | 10.6 |
| Concentrated Fixing Solution: | |
| Ammonium Thiosulfate | 560 g |
| Sodium Sulfite | 60 g |
| Ethylenediaminetetraacetic Acid. Di-Sodium.Di-hydrate | 0.10 g |
| Sodium Hydroxide | 24 g |
| Water to make | 1 liter |
| pH adjusted to 5.10 with acetic acid. | |

At the start of photographic processing, each tank of the automatic processor was filled with the proper processing solution as follows:

Development Tank

After adding 333 ml of the foregoing concentrated developer, 667 ml of water and 10 ml of a starter containing 2 g of potassium bromide and 1.8 g of acetic acid were added to the tank, and the pH was adjusted to 10.25.

Fixing Tank

The fixing tank was filled with 200 ml of the foregoing concentrated fixing solution and 800 ml of water.

Processing Speed: Dry to Dry 30 seconds or 45 seconds
Developing Temperature: 35° C.
Fixing Temperature: 32° C.
Drying Temperature: 55° C.
Replenishing Amounts:
Replenisher of Developer:
22 ml per 10×12 inch sheet of photographic material
Replenisher of Fixing Solution:
30 ml per 10×12 inch sheet of photographic material

Evaluation of Samples

The sensitivity of each of Sample Nos. 9 to 16 was calculated as the reciprocal of the exposure amount giving a density of fog +1.0, where the sensitivity of Sample No. 15 processed for 45 seconds was defined as 100. The results are given in Table 4 below:

TABLE 4

| Sample No. | Sensitivity (30 Second Processing) | Sensitivity (45 Second Processing) |
|---|---|---|
| 9 | 100 | 130 |
| 10 | 105 | 120 |
| 11 | 100 | 125 |
| 12 | 95 | 115 |
| 13 | 60 | 100 |
| 14 | 60 | 90 |
| 15 | 70 | 100 |
| 16 | 50 | 80 |

(Note):
Sample Nos. 9 to 12 are samples of the present invention.

The results in Table 4 show that when a selenium (Se) sensitizer and a tellurium (Te) sensitizer are used together, a particularly high sensitivity is obtained at the high processing speed.

EXAMPLE 3

Preparation of Emulsions T-17 to T-24

The same procedure used to prepare each of Silver Halide Emulsions T-1 to T-4 in Example 1 was repeated, except that thiourea dioxide was added in an amount of $1\times10^{-5}$ mol per mol of silver halide during the formation of the silver halide grains and 30 mg of Sensitizing Dye II-10 of the present invention was added in place of Spectral Sensitizing Dye II-8. The thiourea dioxide was used as a reduction sensitizer. The resulting silver halide emulsions were designated Emulsions T-17 to T-20.

Further, the same procedure used to prepare each of Silver Halide Emulsions T-5 to T-8 in Example 1 was repeated except that thiourea dioxide was added in an amount of $1\times10^{-5}$ mol per mol of silver halide during the formation of the silver halide grains to carry out a reduction sensitization. The resulting silver halide emulsions were designated Emulsions T-21 to T-24.

The characteristics of Silver Halide Emulsions T-17 to T-24 thus-prepared are summarized in Table 5 below:

TABLE 5

| Emulsion | Iodine Content (mol %) | Reduction Sensitization |
|---|---|---|
| T-17 | 0.26 | Applied |
| T-18 | 0.76 | Applied |
| T-19 | 1.26 | Applied |
| T-20 | 3.26 | Applied |
| T-21 | 0.26 | Applied |
| T-22 | 0.76 | Applied |
| T-23 | 1.26 | Applied |
| T-24 | 3.26 | Applied |

Note:
Emulsions T-17 and T-18 are silver halide emulsions of the present invention. The other emulsions are comparative emulsions.

Coating of Sample Nos. 17 to 32

Each of Emulsions T-1 to T-8 from Example 1 and Emulsions T-17 to T-24 described above were coated in the manner described in Example 2 to provide Sample Nos. 17 to 24 and Sample Nos. 25 to 32.

Evaluation of Sample Nos. 17 to 32

Each sample was subjected to a photographic sensitometric evaluation. The results are shown in Table 6 below:

TABLE 6

| Sample No. | Sensitivity (30 Second Processing) | Sensitivity (45 Second Processing) |
|---|---|---|
| 17 | 140 | 185 |
| 18 | 135 | 180 |
| 19 | 70 | 115 |
| 20 | 65 | 110 |
| 21 | 80 | 110 |
| 22 | 65 | 105 |
| 23 | 70 | 110 |
| 24 | 65 | 115 |
| 25 | 110 | 155 |
| 26 | 115 | 145 |
| 27 | 60 | 110 |
| 28 | 55 | 105 |
| 29 | 70 | 100 |
| 30 | 60 | 95 |
| 31 | 60 | 105 |
| 32 | 60 | 110 |

Note:
Samples 17, 18, 25 and 26 are samples of the present invention. The other samples are comparison samples.

The results in Table 6 show that the silver halide emulsions of the present invention provide good photographic performance (i.e., excellent sensitivity).

Note that in Table 6, the sensitivity of each sample was calculated as a relative value where the sensitivity of Sample 29 processed for 45 seconds was defined as 100.

Each of Sample Nos. 9 to 32 prepared in Example 2 and in Example 3 were subjected to a pressure resistance test carried out using the following method.

In a constant-temperature and constant-humidity chamber kept at a humidity of 25% and a temperature of 25° C., each sample was bent using a forcible bending test machine adjusted so that each sample was bent at 30° in 5 seconds.

Each sample was then developed and sensitometrically tested. The value of the density of the blackened, bent portion of each sample after subtracting the fog density therefrom was determined.

The results obtained are shown in Table 7 below:

TABLE 7

| Sample No. | Density of Blackened, Bent Portion | Note |
|---|---|---|
| 9 | 0.15 | Invention |
| 10 | 0.14 | Invention |
| 11 | 0.14 | Invention |
| 12 | 0.13 | Invention |
| 13 | 0.20 | Comparison |
| 14 | 0.20 | Comparison |
| 15 | 0.23 | Comparison |
| 16 | 0.25 | Comparison |
| 17 | 0.14 | Invention |
| 18 | 0.15 | Invention |
| 19 | 0.27 | Comparison |
| 20 | 0.25 | Comparison |
| 21 | 0.18 | Comparison |
| 22 | 0.18 | Comparison |
| 23 | 0.23 | Comparison |
| 24 | 0.24 | Comparison |
| 25 | 0.12 | Invention |
| 26 | 0.13 | Invention |
| 27 | 0.18 | Comparison |
| 28 | 0.19 | Comparison |
| 29 | 0.17 | Comparison |
| 30 | 0.18 | Comparison |
| 31 | 0.19 | Comparison |
| 32 | 0.18 | Comparison |

The results in Table 7 show that the silver halide emulsions for use in the present invention provide excellent pressure resistance in a coated system having a low binder amount and an Ag/binder ratio of at least 0.8.

EXAMPLE 4

When each of Sample Nos. 1 to 32 in Examples 1 to 3 was exposed under set sensitometric conditions and processed using an automatic processor under the following processing conditions, the results confirmed that the silver halide photographic materials of the present invention provide excellent photographic performance, consistent with the results of Examples 1 to 3.

The automatic processor used in the experiment was a Konica Corporation SRX-1001 Automatic Processor modified such that 30 second dry-to-dry processing was possible. The processing steps used are shown in Table 8 below:

TABLE 8

| Processing Step | Amount of Solution in Tank | Processing Temperature | Processing Pass Length | Time (seconds) |
|---|---|---|---|---|
| Development | 15 liters | 35° C. | 613 mm | 8.8 |
| (liquid surface area/tank volume = 25 $cm^2$/liter) | | | | |
| Fixing | 15 liters | 32° C. | 539 mm | 7.7 |
| Washing | 13 liters | 17° C. | 263 mm | 3.8 |
| Squeeze | | | 304 mm | 4.4 |
| Drying | | 58° C. | 368 mm | 5.3 |
| Total | | | 2087 mm | 30 |

In the processing steps shown in Table 8 above, washing was carried out using running water.

The processing solutions and replenishers thereof used in the processing steps were as follows:

Development Processing

Preparation of Concentrated Developer

| Developer | |
|---|---|
| Part A: | |
| Potassium Hydroxide | 330 g |
| Potassium Sulfite | 630 g |
| Sodium Sulfite | 255 g |
| Potassium Carbonate | 90 g |
| Boric Acid | 45 g |
| Diethylene Glycol | 180 g |
| Diethylenetriaminepentaacetic Acid | 30 g |
| 1-(N,N-Diethylamino)ethyl-5-mercapto-tetrazole | 0.75 g |
| Hydroquinone | 450 g |
| 4-Hydroxymethyl-4-methyl-1-phenyl-3-pyrazolidone | 60 g |
| Water to make | 4125 ml |
| Part B: | |
| Diethylene Glycol | 525 g |
| 3,3'-Dithiobishydrocinnamic Acid | 3 g |
| Glacial Acetic Acid | 102.6 g |
| 5-Nitroindazole | 3.75 g |
| 1-Phenyl-3-pyrazolidone | 34.5 g |
| Water to make | 750 ml |
| Part C: | |
| Glutaraldehyde (50 wt/wt %) | 150 g |
| Potassium Bromide | 15 g |
| Potassium Metabisulfite | 105 g |
| Water to make | 750 ml |
| Concentrated Fixing Solution | |
| Ammonium Thiosulfate (70 wt/vol %) | 300 ml |
| Ethylenediaminetetraacetic Acid. Disodium.Dihydrate | 0.45 g |
| Sodium Sulfite | 225 g |
| Boric Acid | 60 g |
| 1-(N,N-Dimethylamino)ethyl-5-mercaptotetrazole | 15 g |
| Tartaric Acid | 48 g |
| Glacial Acetic Acid | 675 g |
| Sodium Hydroxide | 225 g |
| Sulfuric Acid (36N) | 58.5 g |
| Aluminum Sulfate | 150 g |
| Water to make | 6000 ml |
| pH | 4.68 |

Preparation of Developer

Each of Parts A, B and C of the concentrated developer were filled in the following container. The container was composed of partial containers for Parts A, B and C connected to each other to provide one container.

Also, the foregoing concentrated fixing solution was filled in the same sort of a container.

At the start of processing, 300 ml of an aqueous solution containing 54 g of acetic acid and 55.5 g of potassium bromide were added to the developer tank as a starter.

The foregoing containers each containing a processing solution were inverted, and inserted into the automatic processor such that the cutting blade of each stock tank for each processing solution cut the seal membrane of each cap, whereby each processing solution in each container filled each stock tank.

The processing solutions were filled in the developer tank and the fixing tank of the automatic processor in the ratios shown below by driving pumps on the automatic processor.

Also, after processing eight photographic material sheets (each sheet was 10×12 inches in size), a mixture of each concentrated processing solution and water in the ratios given below was replenished to each processing tank of the automatic processor:

| | |
|---|---|
| Developer: | |
| Part A | 55 ml |
| Part B | 10 ml |
| Part C | 10 ml |
| Water | 125 ml |
| pH | 10.50 |
| Fixing Solution: | |
| Concentrated Fixing Solution | 80 ml |
| Water | 120 ml |
| pH | 4.62 |

City water was used in the wash tank.

Also, three polyethylene bottles packed with 0.4 g of pearlite having a mean particle size of 100 μm and a mean pore size of 3 μm packed with a ray fungus as a fur inhibitor were prepared. Two bottles were placed on the bottom of the wash tank and one bottle was placed on the bottom of the stock tank (liquid amount 0.2 liter) for wash waste. The openings of each of the three bottles were covered with a #300 mesh nylon cloth which would pass water and the ray fungus.

A 10×12 inch sheet of each of the light-sensitive materials of Sample Nos. 1 to 32 was exposed to X-rays and processed in the automatic processor using the processing solutions formed by mixing the concentrated processing solutions in the ratios stated above and for the processing times stated above while replenishing 25 ml of the developer and 25 ml of the fixing solution per 10×12 inch sheet of light-sensitive material.

The wash tank was supplied with 5 liters/minute of wash water from a stock tank (0.5 liter per 10×12 inch sheet of light-sensitive material) by opening an electromagnetic ball valve synchronized with the processing time for the light-sensitive material.

Further, the control on the ball valve was set so that when the standby time reached one hour (i.e., no photographic material had been processed for one hour), the electromagnetic ball valve would automatically open for 2 minutes and supply fresh wash water to the wash tank.

Still further, after finishing processing for the day, an electromagnetic valve opening to a drain pipe was set to open to discharge all the wash water in the wash tank. The wash tank was thus drained at the end of each day.

Still further, the controls on the automatic processor were set so that once at start-up each morning and twice daily during stoppages, 40 ml of stock tank water which had been brought into contact with the foregoing fur inhibitor were applied to the crossover rollers disposed between the developer tank and the fixing tan and between the fixing tank and the wash tank to wash the crossover rollers.

EXAMPLE 5

The same procedure used in Example 1 to prepare Emulsion T-1 was repeated except that the addition amounts of Sensitizing Dyes I-4 and II-8 were changed as shown in Table 9. Emulsions T-25 to T-30 were thus prepared.

TABLE 9

| Emulsion | A. Amount of Dye I-4 (mol/mol-Ag) | B. Amount of Dye II-8 (mol/mol-Ag) | B/A |
|---|---|---|---|
| T-1 | $1.38 \times 10^{-3}$ | $1.3 \times 10^{-5}$ | $9 \times 10^{-3}$ |
| T-25 | $0.9 \times 10^{-3}$ | $6 \times 10^{-5}$ | $6.7 \times 10^{-2}$ |
| T-26 | $0.9 \times 10^{-3}$ | $1 \times 10^{-4}$ | 0.11 |
| T-27 | $0.9 \times 10^{-3}$ | $0.8 \times 10^{-5}$ | $8.9 \times 10^{-3}$ |

TABLE 9-continued

| Emulsion | A. Amount of Dye I-4 (mol/mol-Ag) | B. Amount of Dye II-8 (mol/mol-Ag) | B/A |
|---|---|---|---|
| T-28 | $0.6 \times 10^{-3}$ | $8 \times 10^{-5}$ | 0.13 |
| T-29 | $0.6 \times 10^{-3}$ | $1 \times 10^{-5}$ | $1.7 \times 10^{-2}$ |
| T-30 | $1.38 \times 10^{-3}$ | $1.5 \times 10^{-4}$ | 0.11 |

Note:
Emulsions T-1, T-25, T-27, and T-29 are emulsions of the present invention. The others are comparative emulsions.

The same procedures used in Example 1 were repeated with each of Silver Halide Emulsions T-25 to T-30 to prepare Sample Nos. 33 to 38. Sample Nos. 33 to 38 were sensitometrically evaluated in the same manner as the samples in Example 1. The results obtained are shown in Table 10:

TABLE 10

| Sample No. | Sensitivity (8 Second Processing) | Sensitivity (24 Second Processing) |
|---|---|---|
| 1 | 100 | 160 |
| 33 | 90 | 150 |
| 34 | 45 | 105 |
| 35 | 88 | 150 |
| 36 | 48 | 103 |
| 37 | 98 | 138 |
| 38 | 40 | 105 |

To obtain the results reported in Table 10, the sensitivities of the Samples were evaluated using relative sensitivities as in Example 1.

The results in Table 10 show that the amounts of the dyes that are used are important factors in the present invention.

While the invention has been described in detail and with reference to specific embodiments thereof, it will be apparent to those skilled in the art that various changes and modifications can be made therein without departing from the spirit and scope thereof.

What is claimed is:

1. A silver halide photographic material, comprising a support having thereon at least one silver halide emulsion layer, wherein the silver halide emulsion layer contains at least $1\times10^{-4}$ mol of a compound represented by formula (I) per mol of silver halide and from $1\times10^{-3}$ to $1\times10^{-1}$ mol of a compound represented by formula (II) per mol of the compound of formula (I) and the iodine content of the silver halide emulsion is up to 1 mol %:

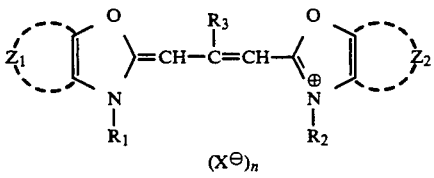

(I)

wherein $R_1$ and $R_2$ each represents a substituted or unsubstituted alkyl group, a substituted or unsubstituted alkenyl group, or a substituted or unsubstituted aryl group, at least one of $R_1$ and $R_2$ is a sulfoalkyl group or a carboxyalkyl group; $R_3$ represents a substituted or unsubstituted alkyl group; $X^{\ominus}$ represents a counter ion necessary to balance the charge of the molecule; n represents a number necessary to balance the charge; and $Z_1$ and $Z_2$ each represents a group of nonmetallic atoms necessary to complete a substituted or unsubstituted benzene ring or a substituted or unsubstituted benzene ring or a substituted or unsubstituted naphtho ring, and when the molecule of formula (I) forms an intramolecular salt, n is 0:

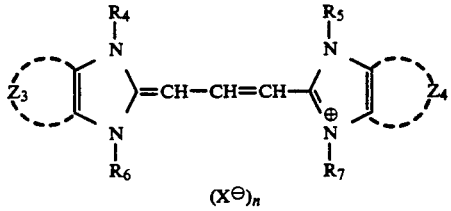

(II)

wherein $R_4$, $R_5$, $R_6$ and $R_7$ each represents a substituted or unsubstituted alkyl group; $X^{\ominus}$ represents a counter ion necessary to balance the charge of the molecule; n represents a number necessary to balance the charge; and $Z_3$ and $Z_4$ each represents a group of nonmetallic atoms necessary to complete a substituted or unsubstituted benzene ring or a substituted or unsubstituted naphtho ring, and when the molecule of formula (II) forms an intramolecular salt, n is 0, wherein the silver halide emulsion layer contains tabular silver halide grains having a mean aspect ratio of at least 3 in an amount such that the tabular grains account for at least 50% of the total projected area of all the silver halide grains in the emulsion layer.

2. The silver halide photographic material as in claim 1, wherein the oxidation potential of the compound represented by formula (II) is, by at least 0.2 eV, more anodic than the oxidation potential of the compound represented by formula (I).

3. The silver halide photographic material as in claim 1, wherein the silver halide emulsion is chemically sensitized with at least one chemical sensitizer selected from the group consisting of selenium compounds and tellurium compounds.

4. The silver halide photographic material as in claim 1, wherein the silver halide emulsion has a silver-to-binder weight ratio of at least 0.8.

5. The silver halide photographic material as in claim 1, wherein the silver halide emulsion is selenium-sensitized with a selenium sensitizer in an amount of at least $1\times10^{-8}$ mol per mol of the silver halide.

6. The silver halide photographic material as in claim 1, wherein the silver halide emulsion is tellurium-sensitized with a tellurium sensitizer in an amount of from $1\times10^{-8}$ to $1\times10^{-2}$ mol per mol of the silver halide.

7. The silver halide photographic material as in claim 1, wherein the silver halide emulsion is chemically sensitized with a gold sensitizer.

8. The silver halide photographic material as in claim 1, wherein the silver halide emulsion is chemically sensitized with a sulfur sensitizer.

9. The silver halide photographic material as in claim 1, wherein the silver halide emulsion is chemically sensitized with a reduction sensitizer.

* * * * *